United States Patent [19]

Donaldson et al.

[11] Patent Number: 5,014,757

[45] Date of Patent: May 14, 1991

[54] BALLOON INFLATING DEVICE

[76] Inventors: Daniel J. Donaldson, 704 Hingham La., Schaumburg, Ill. 60193; William K. Busch, 1233 Center St., DesPlaines, Ill. 60018

[21] Appl. No.: 520,800

[22] Filed: May 8, 1990

[51] Int. Cl.[5] ..... B65B 3/16; B65B 1/04

[52] U.S. Cl. ..... 141/114; 141/10; 141/329; 141/314; 141/317; 116/DIG. 9

[58] Field of Search ..... 141/1, 10, 19, 114, 141/313-317, 329, 330; 53/79, 88, 403; 116/210, DIG. 9, DIG. 8; 137/223, 224

[56] References Cited

U.S. PATENT DOCUMENTS

| | | | |
|---|---|---|---|
| 1,383,115 | 6/1921 | Mendry | 434/138 |
| 2,786,599 | 3/1957 | Higbee | 222/5 |
| 3,020,673 | 2/1962 | Cooke | 446/224 |
| 3,727,229 | 4/1973 | Clinger | 343/706 |
| 4,013,035 | 3/1977 | Kopeika | 116/DIG. 9 |
| 4,142,322 | 3/1979 | Zeyra | 446/224 |
| 4,701,148 | 10/1987. | Cotey | 137/223 |

*Primary Examiner*—Henry J. Recla
*Assistant Examiner*—David J. Walczak
*Attorney, Agent, or Firm*—Terry M. Gernstein

[57] ABSTRACT

A balloon device includes an inner container and an outer container that are movable with respect to each other. The device includes a pressurized gas container mounted in the inner container and a firing mechanism that is operated by slamming the device against a solid surface such as a table top or the like. The firing mechanism punctures the pressurized container and permits gas to escape into the device, and this gas is guided via orifices to the balloon that is sealingly held on the device by an O-ring type element. When the balloon is pressurized to a prescribed pressure, further pressurization of the device will move the inner container and the surface against which the O-ring seats disappears as the inner container moves with respect to the outer container. The balloon is released and sealed as the O-ring is released.

4 Claims, 5 Drawing Sheets

BALLOON INFLATING DEVICE

TECHNICAL FIELD OF THE INVENTION

The present invention relates to the general art of inflatable objects, such as balloons or the like, and to the particular field of devices for inflating balloons.

BACKGROUND OF THE INVENTION

Many parties and gatherings use balloons to enhance the atmosphere of the party. These balloons often have various decorations thereon that fit the theme of the party. A birthday party is one example of a party that uses a multiplicity of balloons.

Furthermore, balloons are often used to convey a message, such as a birthday greeting or the like.

While balloons have a myriad of uses, there is one factor which is common to all such uses. To wit: the balloons must generally be inflated to achieve the desired effect. This may not be a problem of only one or two balloons are use; however, if there are a great number of balloons, such factor can be an annoyance or an inhibition to the use of balloons.

Therefore, the art has included several examples of devices for inflating balloons. Such devices generally attach the uninflated balloon to a source of pressurized gas, such a Helium. The source of gas is generally spaced from the balloon, contains enough gas for a multitude of balloons and includes a special valve to which the balloon is manually attached for inflation and from which the inflated balloon is manually detached after inflation. An example of such devices is disclosed in U.S. Pat. No. 4,142,322.

While effective, such devices are often expensive and generally are not designed for use by children. Such designs thereby preclude one source of fun and entertainment at a party while keeping the job of inflating balloons in the category of drudgery.

While the art also includes devices for inflating signal balloons, see for example the device disclosed in U.S. Pat. No. 3,727,229, or for inflating devices such as life preservers, see for example the device disclosed in U.S. Pat. No. 2,786,599, such devices are intended for a one-time only use and are designed for ruggedness and reliability as opposed to multiple uses which are intended to be entertaining.

Therefore, there is a need for a balloon inflating device which is easy and fun to use especially for children and which can be re-used.

OBJECTS OF THE INVENTION

It is a main object of the present invention to provide a balloon inflating device which is easy and fun to use especially for children.

It is another object of the present invention to provide a balloon inflating device which is easy and fun to use especially for children and which can be re-used.

SUMMARY OF THE INVENTION

These, and other, objects are achieved by a balloon inflating device which includes a pressurized fluid container that is removably mounted in a container and which is opened when the device is impacted on a hard surface, such as a floor or a table or the like. The balloon is releasably and sealingly held on the device prior to and during inflation, and is automatically released and sealed when a predetermined inflation pressure is achieved. The pressurized fluid container can be sold separately and replaced after each use. In fact, a box of balloons can include the device as well as enough pressurized fluid containers to inflate all of the balloons in the box.

BRIEF DESCRIPTION OF THE DRAWING FIGURES

DETAILED DESCRIPTION OF THE PREFERRED EMBODIMENT OF THE INVENTION

Figure 1:
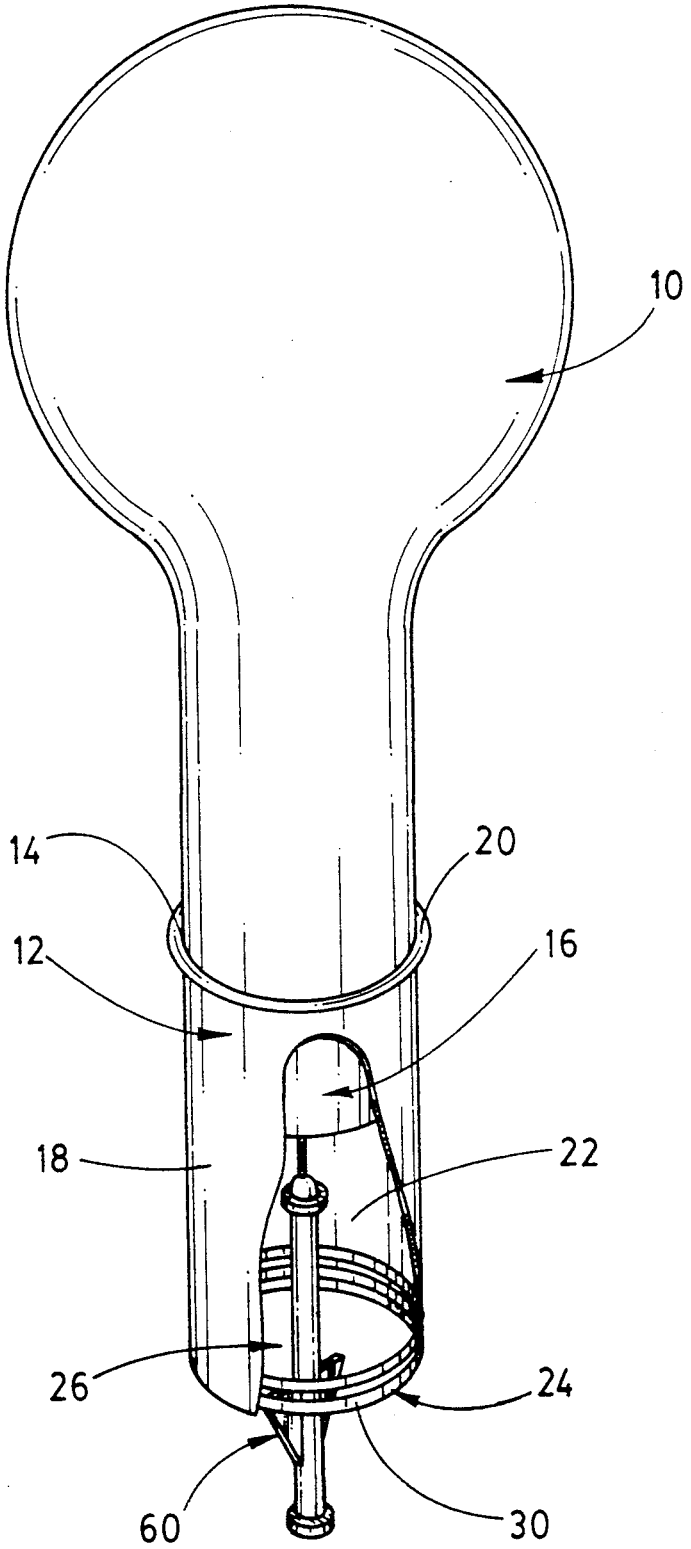
FIG. 1 is a perspective view of the balloon inflating device of the present invention in conjunction with a balloon.

Shown in FIG. 1 is a balloon 10 that has been partially inflated by an inflation device 12 of the present invention. The device is fluidically attached to the mouth 14 of the balloon to transfer pressurized gas, such as air, Helium or the like, from a pressurized gas container 16 into the balloon via the balloon mouth that is sealingly attached to the outside surface 18 of the device by a sealing device, such as an O-ring 20 or the like.

The device 12 works by impacting it against a hard surface, such as a floor or a table or the like after attaching an uninflated balloon to the top of the device.

To this end, the device 12 includes two cylindrical containers 22 and 24 and a firing mechanism 26 mounted on the cylindrical containers and located adjacent to the pressurized fluid container 16 that is mounted to an inner container 22 which is slidably mounted within the outer container 24.

Figure 2:
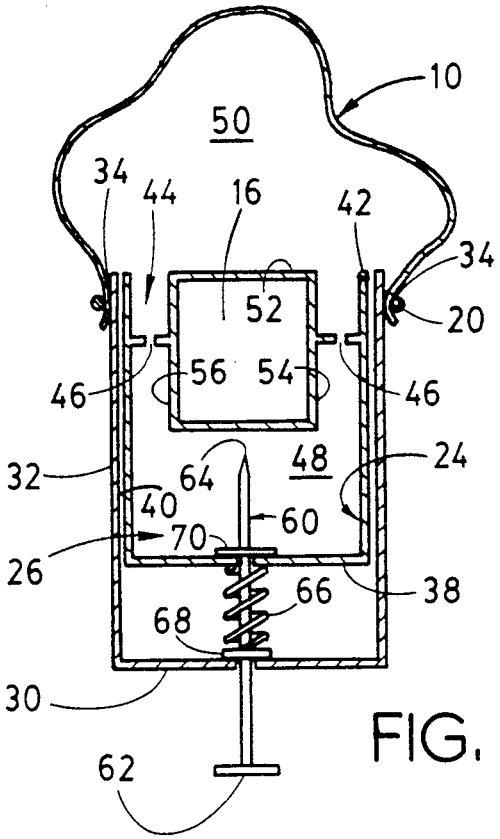
FIG. 2 is a cutaway elevational view of the balloon inflating device of the present invention in a cocked position.

Referring to FIGS. 1 and 2, it is seen that the outer container 22 is cylindrical and includes a circular bottom 30 having a bore defined centrally thereof and a wall 32 extending upwardly therefrom to an upper rim 34 thereon. The outer container has a height dimension as measured from the bottom wall to the upper rim. As shown in FIG. 2, the balloon is in sealing contact with the outer wall adjacent to the upper rim and the sealing O-ring 20 presses the balloon against the outer surface immediately subadjacent to and against the upper rim 34.

The inner container 24 is also cylindrical and includes a circular bottom 38 that has a diameter slightly smaller than the diameter of the outer container bottom wall 30 and a wall 40 that extends upwardly from the bottom 38 to an upper rim 42 to have a height as measured between the bottom 38 and rim 40 that is slightly less than the height of the outer wall 32. The inner container bottom has a hole centrally located therein to be aligned with the outer container hole for a purpose that will be evident from the ensuing discussion.

Figure 5:
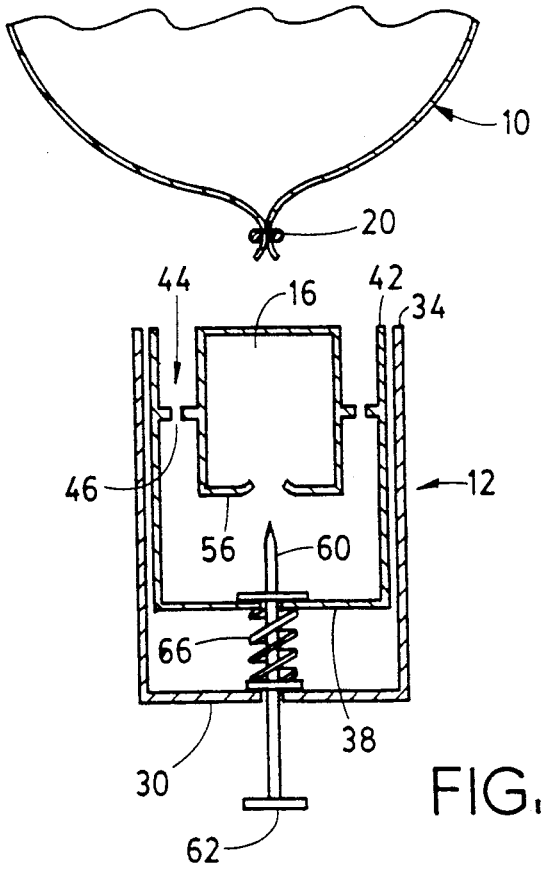
FIG. 5 is a cutaway elevational view of the balloon inflating device of the present invention in a balloon-releasing position.

The inner container 24 is mounted in the outer container to slide from a first position having the inner container upper rim 40 spaced above the outer container upper rim 34 by a small amount and the inner container bottom 38 spaced above the outer container bottom 30 by a certain amount to a second position having the inner container upper rim co-level with or below the outer container rim. The first position is illustrated in FIG. 2 and the second position is illustrated in FIG. 5. For the sake of clarity, the first position will also be referred to as a cocked position and the second position will also be referred to as a balloon-releasing position.

The pressurized fluid container is cylindrical and is mounted on the inner container wall for movement therewith by a spider-like mount 44 that has at least two orifices 46 located on diametrically opposite sides of the cylindrical pressurized fluid container 16. The orifices provide a controlled fluidic connection between the volume 48 beneath the container 16 and the balloon interior indicated in FIG. 2 by the reference numeral 50.

The container 16 is cylindrical and includes a circular bottom 52 that has a diameter smaller than the diameter of the inner container bottom 38 and which is located adjacent to a plane containing the upper edge 42 of the container which edge forms an open top of the inner container. A wall 54 extends downwardly (in the FIG. 2 orientation) from the bottom 52. The container 16 also includes a rupturable top 56 made of an elastomeric material, such as thin rubber or the like that sealingly closes the container in a manner that prevents fluid stored under pressure in the container from escaping until it is desired to permit such fluid to escape as will be discussed below. The top 56 will be formed of material that will prevent the pressurized gas contained in the container from escaping by diffusing through such top, and thus may include a metal portion with a central puncturably portion located to be aligned with the aligned holes in the container bottoms 30 and 38. In some instances, rubber may be sufficient; however, in the case of Helium, such material may not be sufficient to prevent that gas from diffusing out of the container. In the case of Helium, the top 56 may have to be primarily metal as above discussed.

The container is releasably held in the mount 44 by a friction fit or by a snap fit if the container has an indentation defined in the outer surface thereof. The container is removed by applying an upward force on the container that is sufficient to overcome the friction fit or the snap fit and pulling the container out of the device via the open top of the containers 22 and 24. The space between the container wall 54 and the container wall 40 defines a finger hold for the container 16. The container 16 is cylindrical and can be bullet shaped to facilitate this insertion and removal process.

The firing mechanism 26 includes a firing pin 60 having a needle-like shape with a head 62 on one end and a point 64 on the other end thereof. The firing pin is slidably mounted in the aligned bottom holes adjacent to the puncturably portion of the container top 56 to move from a FIG. 2 cocked position with the point spaced from the container top 56 to a FIG. 3 rupturing position with the point located inside the container 16 after having passed through such top and puncturing such top.

The firing mechanism also includes a spring 66 seated at one end against the inner container bottom 38 and seated at the other end thereof against a spring stop 68 on the firing pin 60 to bias the inner container towards the first position thereof shown in FIG. 2. A sealing gasket 70 is fixed to the firing pin to seal the hole in the inner container bottom when the device is in the cocked position (FIG. 2) and when the device is in a balloon-inflating position shown in FIG. 4 so that fluid escaping from the container 16 will not leak out of the device via the aligned holes in the bottoms 30 and 38.

Operation of the device is best understood by viewing FIGS. 2–5 in sequence. The device is first loaded by placing a full pressurized fluid container 16 into the mounting means. The device automatically assumes a cocked position of FIG. 2 due to the action of the spring 66.

The device is actuated by first securing a balloon to the device by capturing the neck portion of the balloon against the upper rim 34 and against the inner container wall immediately subadjacent to the inner container wall upper rim 42 using the O-ring 20. This O-ring 20 is sized to sealingly close a balloon when that balloon is inflated yet is flexible enough to fit around the outer container wall and sealingly capture the balloon against the device. The overlap between the inner container wall and the outer container wall serves as a seat for this balloon capturing function. The overlap is sized to be just enough to provide enough surface area to seat the O-ring for this sealing function. A preferred size of the overlap is equal to the diameter dimension of the O-ring.

Figure 3:
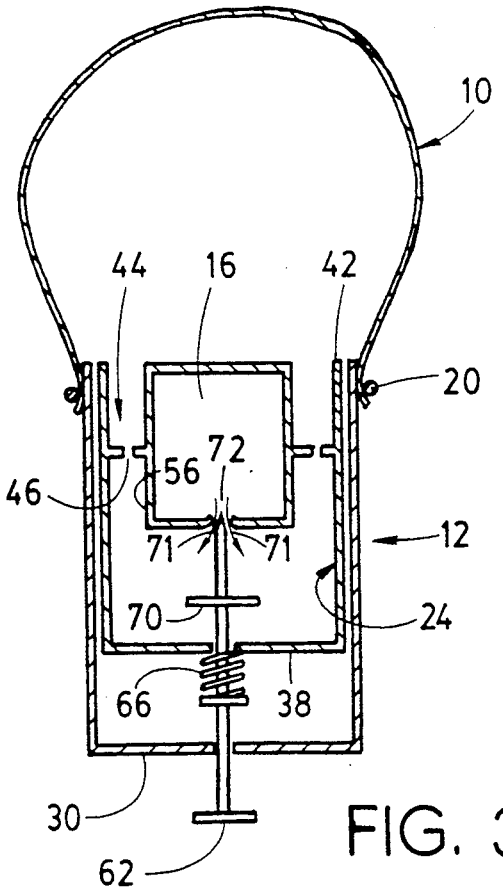
FIG. 3 is a cutaway elevational view of the balloon inflating device of the present invention in a firing position.

The device is actuated by impacting the firing pin head 62 sharply against a surface in a direction to force that firing pin inwardly of the device into the rupturing position shown in FIG. 3 against the bias of the spring 66. The firing pin is forced through the container top 56 as shown in FIG. 3 to puncture and open that top. Opening the top permits the pressurized fluid in that container to escape as indicated in FIG. 3 by the arrows 71 via the hole 72 made by the puncturing action of the firing pin.

Figure 4:
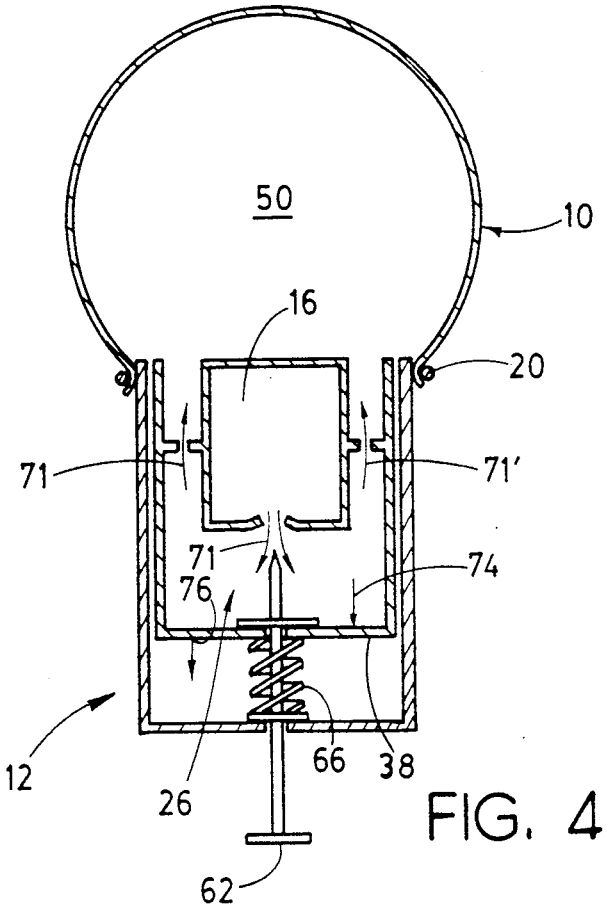
FIG. 4 is a cutaway elevational view of the balloon inflating device of the present invention in a post-firing position.

The pressurized gas escapes into the volume 48 and fills that volume. The spring 66 moves the firing pin back into the cocked position with the gasket 70 seated against the inner container bottom adjacent to the hole in that bottom to seal the volume except for the orifices 46. The pressurized gas fills the volume 48 and moves through the orifices 46 into the balloon as indicated in FIG. 4 by the arrows 71'. The O-ring seals the balloon against the escape of this pressurized gas so the balloon inflates as indicated in FIG. 4.

When the balloon is inflated to a prescribed pressure, the further escape of pressurized gas from the container 16 will apply force to the inner container bottom as indicated in FIG. 4 by arrow 74. This force is opposed to the biasing force exerted by the spring 66, and the spring force is adjusted so that the inner container will move under the influence of such pressure-induced force at the prescribed pressure within the volume 48. The inner container will move relative to the outer container since there is no connection between such container except via the spring 66 which is being compressed.

When the inner container moves, it moves downwardly as indicated in FIG. 4 by the arrow 76 towards the bottom of the outer container. This movement causes the inner container wall subadjacent to the upper rim 42 to move downwardly with respect to the outer container wall upper edge 34 thereby causing the surface on which the O-ring 20 is seated to disappear. As soon as this seating surface disappears, the O-ring is released and pulls the balloon off of the device as indicated in FIG. 5.

Since the O-ring is selected to sealingly close the balloon, the balloon will automatically be sealed upon release from the device. Any remaining gas will, of course, escape to the environment.

Figure 6:
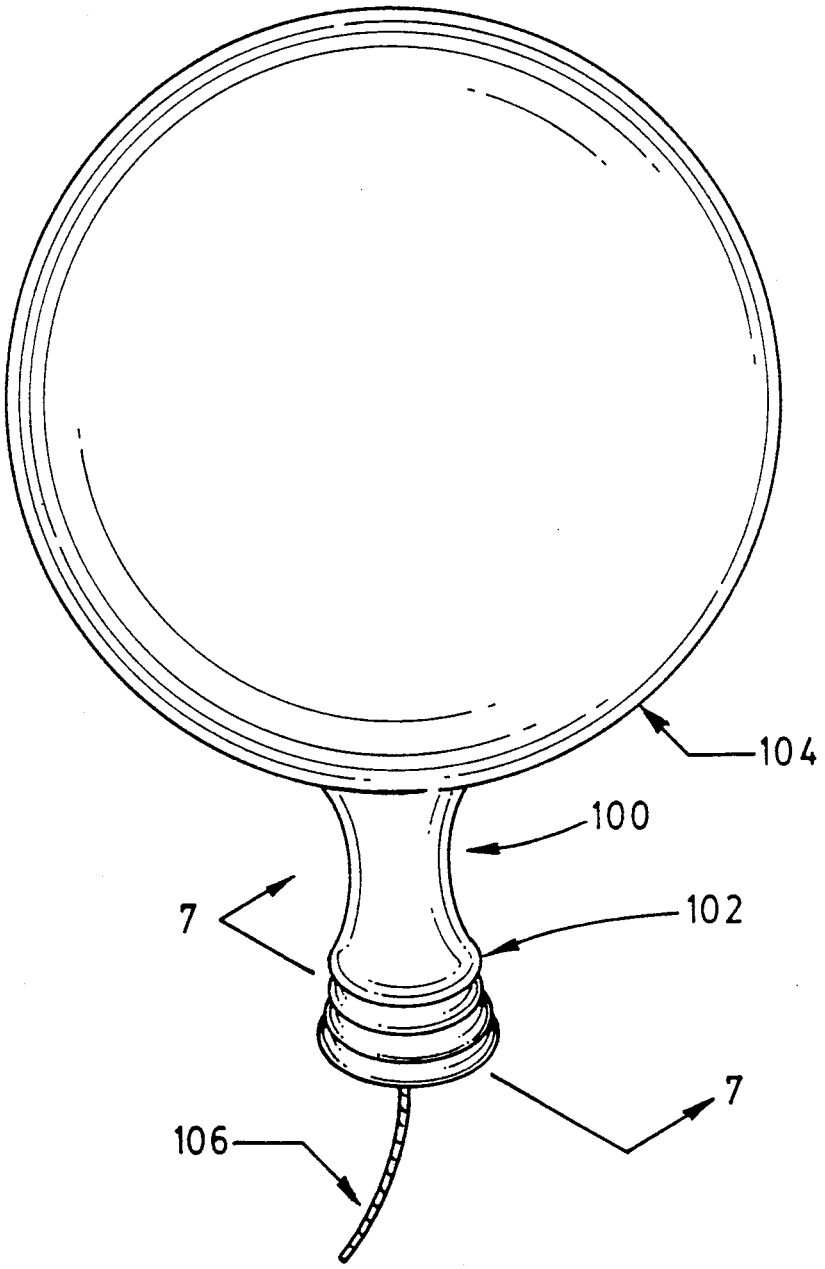
FIG. 6 is a perspective view of a balloon having an alternative form of the inflating device therein.
Figure 7:
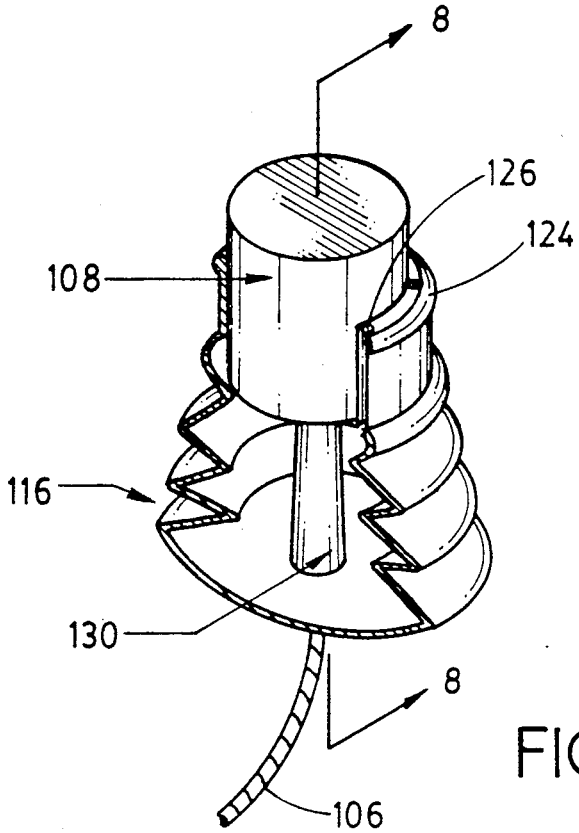
FIG. 7 is an elevational perspective view taken along line 7—7 of FIG. 6.
Figure 8:
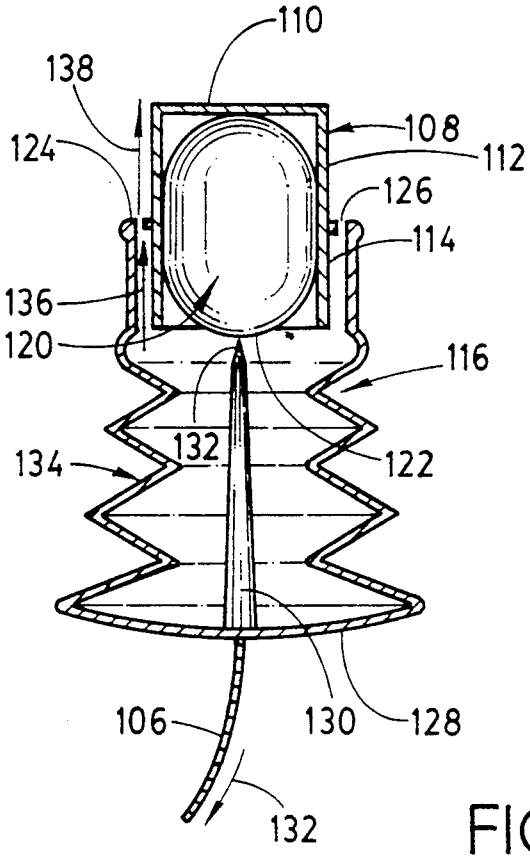
FIG. 8 is an elevational view taken along line 8—8 of FIG. 7.

Shown in FIGS. 6–8 is a balloon inflation device 100 which is an alternative embodiment of the above-disclosed balloon inflating device. the device 100 is located in neck 102 of balloon 104, and is activated by pulling on an activating cord 106 and releasing that cord.

As is best shown in FIGS. 7 and 8, the device 100 includes an outer container 108 which has a top 110 and a cylindrical wall 112 snugly held in a cylindrical section 114 of a spring housing 116. The outer container 108 has an inner container 120 snugly mounted therein, with the inner container having balloon-inflating gas, such as helium, or the like, contained therein, The inner container 120 has a frangible end 122 located remotely from the container top 110.

The spring housing 116 is rubber-like and is sized so the cylindrical section 114 is just slightly larger than the cylindrical wall 112. The spring housing is attached to the wall 112 by an annular flange 124 having an annular opening 126 defined therethrough.

The spring housing 116 further includes a conical spring section 134 and a bottom wall 128 spaced from flange 124. The resiliency of spring section 134 is such that the bottom wall 128 will overshoot the FIG. 8 position and move closer to the to the flange 124 after it is pulled away from that flange and released. In other words, after pulling the wall 128 away from the position relative to the flange 124 shown in FIG. 8 and then releasing that wall, that wall will move past the FIG. 8 position relative to the flange, and closer to that flange than is shown in FIG. 8 and then move back to the FIG. 8 position in the manner of a spring oscillating about a particular location upon being stretched and released.

A puncturing element, such as needle 130, is mounted on the wall 128 to have a point 132 thereof in close proximity to, and possibly light abutting contact with, the frangible end 122 of the container 120. The cored 106 is also attached to the wall 128.

Pulling the cord in the direction indicated in FIG. 8 by the arrow 132 pulls the wall away from the flange 124 and hence pulls the needle point 132 away from the container frangible end 122. Releasing the cord 106 permits the natural resiliency of the spring housing to cause the needle point to move through that frangible end, thus breaking the container and permitting gas to escape therefrom.

Such gas moves in the direction of arrows 134 and 136 around the container 108 and through the annular opening 126 as indicated by arrow 138.

The balloon neck 102 is fit about the spring housing 116 and thus gas moving in direction 138 moves into the interior of the balloon to inflate such balloon. The spring housing section 122 is sized to fit snugly in the balloon neck so that gas will not move out of the balloon past such housing.

It is understood that while certain forms of the present invention have been illustrated and described herein, it is not to be limited to the specific forms or arrangements of parts described and shown.

We claim:

1. A balloon inflating device comprising:

an outer container having a bottom and a side wall and having a hole defined in said bottom, said side wall having a height and a top edge;

an inner container having a bottom and a side wall and having a hole defined through said inner container bottom to be aligned with the hole in said outer container bottom, said inner container side wall having a height which is less than said outer container wall height and a top edge, said inner container bottom being smaller than said outer container bottom and said inner container being mounted within said outer container to slide within said outer container from a first position with said inner container side wall extending above said outer container side wall to a second position with said inner container side wall top edge being no higher than co-level with said outer container top edge with respect to said outer container bottom;

a pressurized fluid container located within said inner container and including a rupturable wall;

mounting means mounting said pressurized fluid container on said inner container for movement therewith;

fluid passage means on said mounting means for conducting pressurized fluid past said pressurized fluid container out of said inner container;

rupturing means slidably mounted on said inner and outer container through said aligned holes and including a head located beneath said outer container bottom and a point located adjacent to said pressurized fluid container rupturable wall, said rupturing means being movable from a cocked position having said point spaced from said rupturable wall to a rupturing position having said point puncturing through said rupturable wall;

sealing means on said rupturing means for sealingly covering said inner container hole;

biasing means on said rupturing means and having one end thereof mounted on said rupturing means and another end thereof engaging said inner container bottom and biasing said inner container toward said first position and said rupturing means towards said cocked position; and balloon closing means located to capture a balloon against said inner container side wall closely adjacent to said inner container side wall top edge and seal said balloon against said inner container side wall and against said outer container side wall when said inner container is in said first position.

2. The balloon inflating device defined in claim 1 wherein said mounting means includes means releasably mounting said pressurized fluid container on said inner container.

3. The balloon inflating device defined in claim 2 wherein said rupturing means includes a needle.

4. A method of inflating a balloon comprising providing the device defined in claim 1;

placing the pressurized container in the inner container;

placing a balloon on the device;

sealing the balloon against the inner container using the sealing means;

impacting the head of the rupturing means against a solid surface and driving that rupturing means from the cocked position to the rupturing position;

withdrawing the rupturing means from the pressurized fluid container to open a hole in that pressurized fluid container;

permitting fluid from the pressurized container to flow out of the pressurized container;

guiding the pressurized fluid from the pressurized container around the pressurized container into the balloon via the fluid passage means;

filling the balloon to a prescribed pressure;

continuing to permit gas to escape from the pressurized container and applying gas pressure-induced force against the bottom of the inner container in a direction opposite to the bias exerted by that biasing means;

forcing the inner container bottom toward the outer container bottom and moving the inner container wall downwardly with respect to the outer container wall until the inner container is in the second position; and releasing the balloon and the balloon closing means.

* * * * *